US008396408B2

(12) United States Patent
Amemiya et al.

(10) Patent No.: US 8,396,408 B2
(45) Date of Patent: Mar. 12, 2013

(54) CLEANING DEVICE, PROCESS CARTRIDGE, AND IMAGE FORMING APPARATUS

(75) Inventors: Ken Amemiya, Tokyo (JP); Satoshi Hatori, Yokohama (JP); Toshio Koike, Machida (JP); Yuji Arai, Kawasaki (JP); Takuma Iwasaki, Ebina (JP); Shinya Karasawa, Kawasaki (JP); Yuta Azeyanagi, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 427 days.

(21) Appl. No.: 12/662,672

(22) Filed: Apr. 28, 2010

(65) Prior Publication Data

US 2010/0316422 A1 Dec. 16, 2010

(30) Foreign Application Priority Data

Jun. 12, 2009 (JP) ..... 2009-141000

(51) Int. Cl.
*G03G 21/00* (2006.01)

(52) U.S. Cl. ..... 399/346

(58) Field of Classification Search ..... 399/346, 399/343

See application file for complete search history.

(56) References Cited

U.S. PATENT DOCUMENTS

| | | | | |
|---|---|---|---|---|
| 7,583,925 | B2 | 9/2009 | Karasawa | |
| 2007/0122217 | A1 * | 5/2007 | Nagashima et al. | 399/346 |
| 2008/0118285 | A1 | 5/2008 | Karasawa | |
| 2009/0103944 | A1 | 4/2009 | Shintani et al. | |
| 2009/0120356 | A1 | 5/2009 | Karasawa et al. | |
| 2009/0241830 | A1 | 10/2009 | Koike et al. | |
| 2010/0021205 | A1 | 1/2010 | Honjoh et al. | |
| 2010/0034557 | A1 | 2/2010 | Arai et al. | |
| 2010/0129126 | A1 | 5/2010 | Kosuge et al. | |

FOREIGN PATENT DOCUMENTS

| | | | |
|---|---|---|---|
| JP | 2005-181742 | | 7/2005 |
| JP | 2007003685 A | * | 1/2007 |
| JP | 2007178545 A | * | 7/2007 |
| JP | 2008-040056 | | 2/2008 |

OTHER PUBLICATIONS

Machine translation of Sawada, JP 2007-178545.*
Machine translation of Ninomiya, JP 2007-3685.*

* cited by examiner

*Primary Examiner* — David Gray
*Assistant Examiner* — Sevan A Aydin
(74) *Attorney, Agent, or Firm* — Harness, Dickey & Pierce

(57) ABSTRACT

A cleaning device includes a cleaning blade configured to clean a surface of a rotating subject, a solid lubricant configured to reduce the friction coefficient of the surface of the subject, and a lubricant coating device that includes a coating roller to shave the solid lubricant during normal rotation and a reverse rotation to coat the surface of the subject with the lubricant. The amount of lubricant supplied to the subject during normal rotation of the coating roller is different from a supply amount of the lubricant during reverse rotation of the coating roller, with more lubricant supplied during reverse rotation than during normal rotation.

12 Claims, 5 Drawing Sheets

CLEANING DEVICE, PROCESS CARTRIDGE, AND IMAGE FORMING APPARATUS

The present patent application is based on and claims priority under 35 U.S.C. §119 from Japanese Patent Application No. 2009-141000, filed on Jun. 12, 2009 in the Japan Patent Office, the entire contents of which are incorporated herein by reference.

BACKGROUND OF THE INVENTION

1. Field of the Invention

The present invention relates to a cleaning device, a process cartridge, and an image forming apparatus, and more particularly to a cleaning device that is capable of efficient cleaning, a process cartridge that incorporates the cleaning device, and an image forming apparatus that incorporates the cleaning device or the process cartridge including the cleaning device.

2. Discussion of the Background

A related-art image forming apparatus, such as a copying machine, a facsimile machine, a printer, or a multifunction printer having two or more of copying, printing, scanning, and facsimile functions, forms a toner image on a recording medium (e.g., a sheet) using an electrophotographic method. In such an image forming apparatus, for example, a surface of a photoconductor, that is a image carrier, is charged by providing a charge with a predetermined polarity. The charged surface of a photoconductor is exposed by a light beam to form an electrostatic latent image. Charged toner of the same polarity as a charging electrode is supplied to the electrostatic latent image to form a toner image on the photoconductor. The toner image formed on the photoconductor is transferred onto a recording medium such as a sheet of paper. The toner image is then fixed onto the recording medium by heat and pressure.

Residual toner that is not transferred during a transfer process of the toner image remains on the surface of the photoconductor. Accordingly, it is necessary to clean the surface of the photoconductor by removing the residual toner before the following charging process. This cleaning is done using a cleaning unit, configured for example, as a cleaning blade and cleaning brush.

A problem arises, however, when downsized toner or spherical toner is used, because it is difficult to remove the residual toner sufficiently using the usual cleaning methods. Therefore, to improve cleaning efficiency, it is proposed to form a thin coating film by applying a lubricant of, for example, fatty acid metal salt, onto the surface of the photoconductor to reduce friction coefficient of the surface of the photoconductor. When the friction coefficient of the surface of the photoconductor is reduced, adhesive force between the toner and the photoconductor decreases and blade cleaning becomes effective, helping to reduce toner filming.

Generally, the lubricant is applied onto the image carrier using a lubricant coating roller, in which a solid lubricant is pressed against the coating roller, such as a brush roller, to shave the lubricant off. The lubricant shaved off by rotating a coating roller is coated on the surface of the photoconductor.

In a cleaning device that includes such a lubricant coating device, whenever a new photoconductor and cleaning blade are installed or it is necessary to print an image at very high resolution the cleaning device is generally operated in a lubricant coating mode, in which the amount of lubricant is deliberately increased. Although such an increase is needed for new parts, if the coating amount of the lubricant is increased during ordinary printing, excess lubricant may attach to the charging roller, possibly resulting in production of an abnormal image and scumming when excess lubricant enters a developing device. Therefore, it is preferable to increase the coating amount of the lubricant only while the device is operating in the lubricant coating mode.

Accordingly, a variety of lubricant coating devices and methods have been employed to implement the lubricant coating mode. For example, the coating mode may include a blind rotation mode between printing operations, in which the photoconductor and the coating roller are rotated without performing an actual printing operation. The blind rotation mode is continued until a sufficient amount of lubricant coats the surface of the photoconductor.

This reliable procedure is highly effective in preventing a blade from being rolled when a new blade is installed and avoiding cleaning failure during printing of an image with high resolution. However, this procedure requires a waiting time because it is not possible to print while the blind rotation mode is performed. Further, the blind rotation mode itself adds wear on sliding members such as roller bearings of the photoconductor and the coating roller the longer it continues, adversely affecting service life of the device.

SUMMARY OF THE INVENTION

This patent specification describes a novel cleaning device that includes a cleaning blade configured to clean a surface of a subject that is to be cleaned and rotates, a solid lubricant configured to reduce friction coefficient of the surface of the subject, and a lubricant coating device that includes a coating roller to shave the solid lubricant during normal rotation and a reverse rotation to coat the surface of the subject with the lubricant. An amount of the lubricant supplied to the subject during normal rotation of the coating roller is different from the amount of the lubricant supplied during reverse rotation of the coating roller, with more lubricant being supplied during reverse rotation than during forward rotation.

This patent specification further describes a novel process cartridge that includes a photoconductor that is a subject to be cleaned, and the cleaning device described above. The photoconductor and the cleaning device are integrated in the process cartridge.

This patent specification further describes a novel image forming apparatus that includes an image carrier configured to form an electrostatic latent image, a charging device configured to charge a surface of the image carrier uniformly by a charging member applied with a potential externally, an exposure unit configured to write the electrostatic latent image on the charged surface of the image carrier based on image data, a developing device configured to visualize the electrostatic latent image formed on the surface of the image carrier, a transfer unit configured to transfer the visualized image on the surface of the image carrier onto a medium, and the cleaning device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
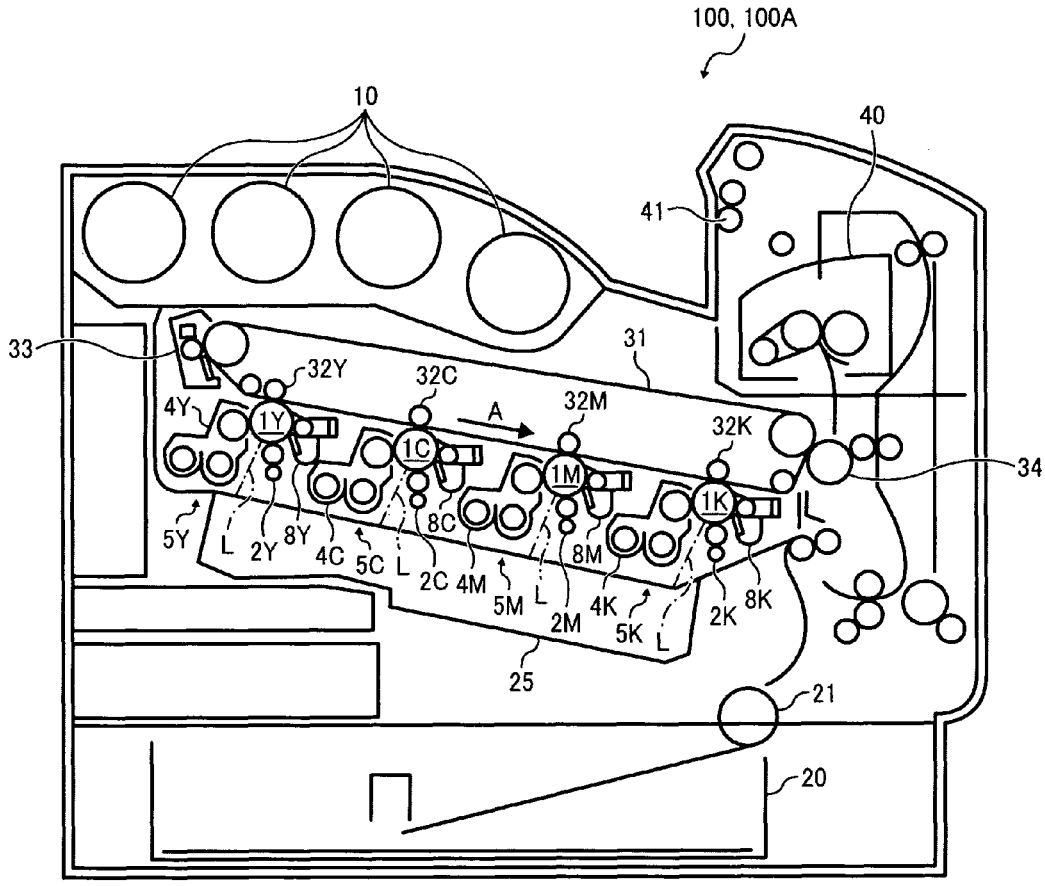
FIG. 1 is a cross-sectional view of an example of an image forming apparatus according to the present disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would hen be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 100 according to an embodiment of the present patent application is described.

[First Embodiment]

FIG. 1 is a cross-sectional view of an image forming apparatus 100 according to a first embodiment of the present disclosure. The image forming apparatus 100 according to the first embodiment is a color image forming apparatus 100 that forms an image using four color toners, yellow(hereinafter, expressed as Y), magenta(hereinafter, expressed as M), cyan (hereinafter, expressed as C), and black(hereinafter, expressed as K). The image forming apparatus 100 includes an image forming unit 5 of four image forming units 5Y, 5M, 5C, and 5K, each having four photoconductors 1Y, 1M, 1C and 1K, respectively. Each photoconductor is driven to rotate in a direction shown by arrow A in FIG. 1 by touching an intermediate transfer belt 31. The image forming apparatus 100 further includes a sheet feeding cassette 20 disposed at a lower portion of the image forming apparatus 100. The sheet feeding cassette 20 accommodates recording medium to be conveyed by a paper feed roller 21.

Figure 2:
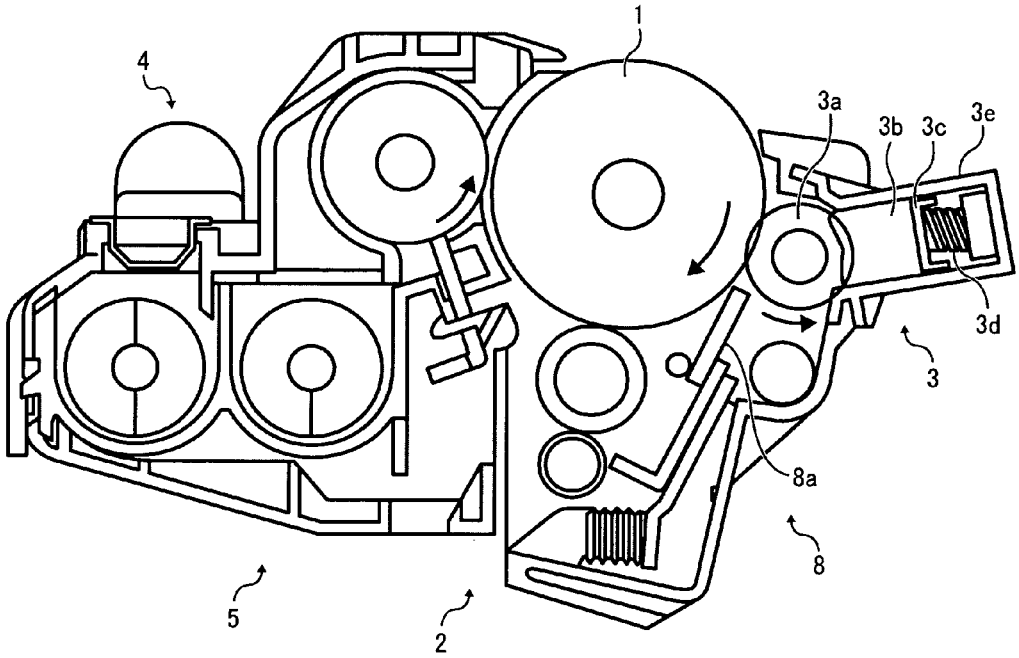
FIG. 2 is a schematic diagram representing an example of an image forming unit.

FIG. 2 is a schematic representing an image forming unit 5 of four image forming units 5Y, 5M, 5C, and 5K. Since all four image forming units 5Y, 5M, 5C, and 5K are essentially identically, only one image forming unit 5 intended to be representative of all four units is shown in FIG. 2. A process cartridge that includes a charging device 2, a developing unit 4, a lubricant coating device 3, and a cleaning device 8 provided around the photoconductor 1 is provided at each image forming unit. The charging device 2 charges the surface of the photoconductor 1. The developing unit 4 develops an electrostatic latent image formed on the surface of the photoconductor 1 by each color toner to form a toner image. The lubricant coating device 3 coats the lubricant on the surface of the photoconductor 1. The cleaning device 8 cleans the surface of the photoconductor 1 after a transfer process of the toner image.

The process to obtain a color image will be now described. In FIG. 1, toner is supplied to each color developing unit 4 in a predetermined amount from toner bottles 10 that contain yellow, magenta, cyan, and black toner, respectively from the left in FIG. 1 through respective conveyance path, not shown. A sheet of paper is conveyed by a paper feed roller 21 to a nip formed between a secondary transfer roller 34 and the intermediate transfer belt 31. A laser light L from a writing unit 25 is emitted to scan and expose the photoconductor charged uniformly by the charging device 2 to form an electrostatic latent image on the surface of the photoconductor 1. Each electrostatic latent image is developed by respective color developing unit 4. Thus, toner images of yellow, magenta, cyan, and black are formed on the photoconductor 1. Toner located at a position of the intermediate transfer belt 31 that faces a primary roller 32 to which a potential is applied is transferred onto the intermediate transfer belt 31. Performance of each color image forming operation is timed differently depending on position upstream to downstream, so that the toner image is formed at the same position on the intermediate transfer belt 31, thus superimposing each color toner image on top of the preceding color toner image.

The image formed on the intermediate transfer belt 31 is conveyed to the secondary transfer roller 34 and from there is transferred onto the paper, in a process also called secondary transfer. The paper onto which each toner image is transferred is conveyed to a fixing unit 40 to fix the image by heat and pressure, and is output by an outputting roller 41. Residual toner remaining on the photoconductor 1 is cleaned by each cleaning unit 8 provided in each image forming unit. Further, residual toner remaining on the intermediate transfer belt 31 is cleaned by a transfer cleaning unit 33. Waste toner collected by this cleaning operation is ejected to a waste toner bottle, not shown, provided in the image forming apparatus 100 from the process cartridge by a waste toner conveyance screw provided in each cleaning unit. Each cleaning unit 8 includes a lubricant coating device 3 that includes a cleaning blade 8*a*, a brush roller 3*a*, and a waste toner conveyance screw, not shown.

The cleaning blade 8*a* is formed of high-polymer materials such as gum rubber, and is provided so as to touch the surface of overall photoconductor 1 along a width direction with a predetermined angle. When the photoconductor 1 is rotated, residual toner attached to the surface of the photoconductor 1 is removed by the cleaning blade 8*a* contacting the surface of the photoconductor 1 with a predetermined angle.

The lubricant coating device 3 is provided upstream from the cleaning blade 8*a* on the surface of the photoconductor 1.

The lubricant coating device 3 will now be described referring to FIGS. 3A, 3B, 4A and 4B.

Figure 3A:
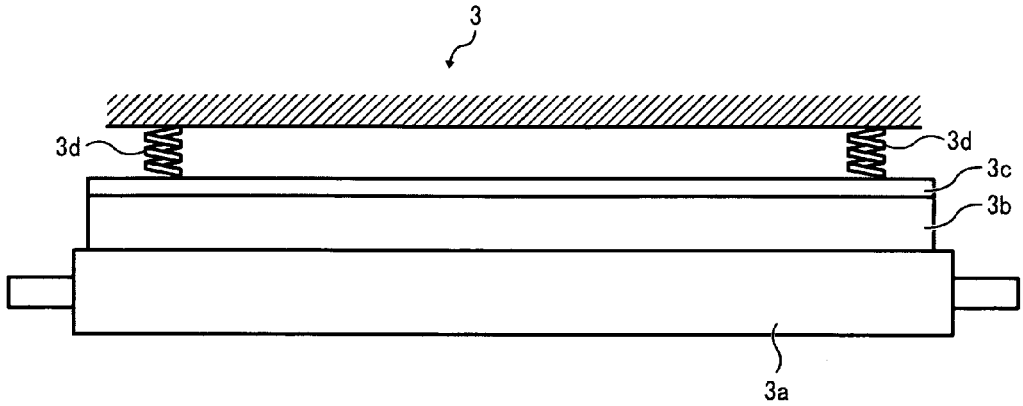
FIGS. 3A and 3B are schematic diagrams representing solid lubricant coating devices according to a first embodiment.
Figure 3B:
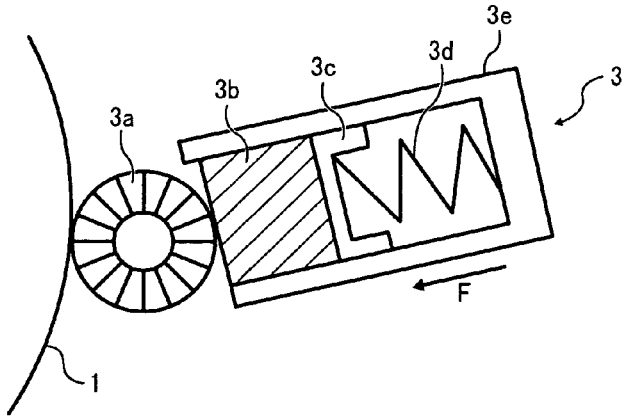

FIG. 3A is a front view of solid lubricant coating device. FIG. 3B is a magnified cross sectional view of solid lubricant coating devices 3 in an axial direction.

The lubricant coating device 3 includes a brush roller 3*a*, solid lubricant 3*b*, a lubricant holder 3*c*, a pressure member (pressure spring) 3*d*, and a lubricant storage case 3*e*. The solid lubricant 3*b* is slidably provided inside the lubricant storage case 3*e* fixed to the image forming apparatus 100. The brush roller 3*a* shaves the lubricant off to coat the lubricant on the photoconductor 1. Further, the solid lubricant 3*b* is pressed to the brush roller 3*a* by the pressure member 3*d* (as shown by arrow F) through the lubricant holder 3*c*.

Figure 4A:
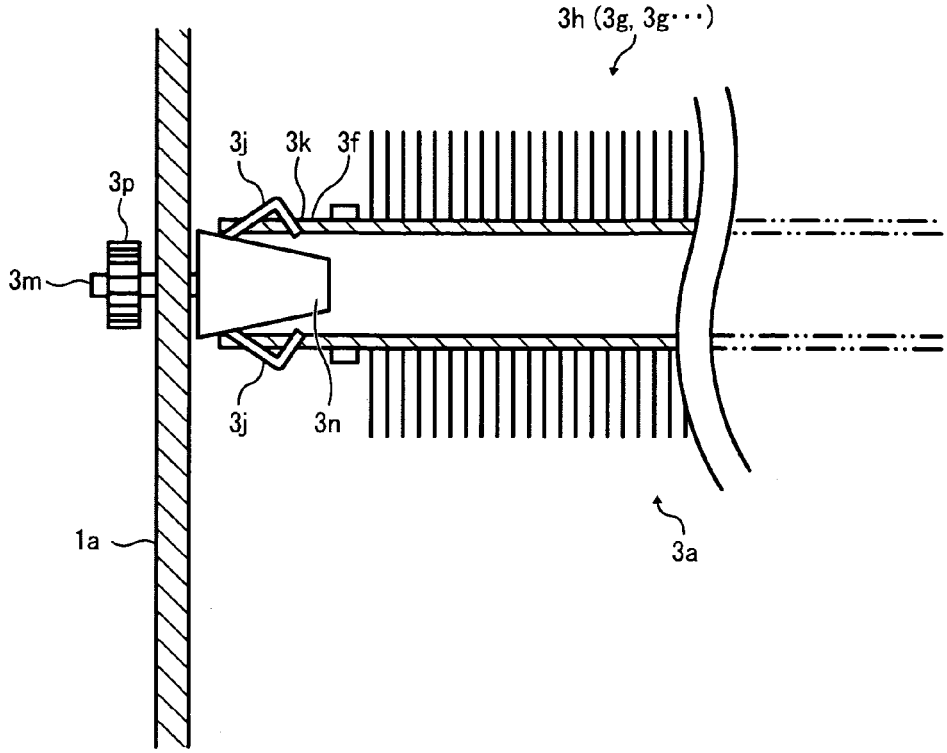
FIGS. 4A and 4B are magnified views of a brush roller showing how the brush roller touches a top portion of the lubricant.
Figure 4B:
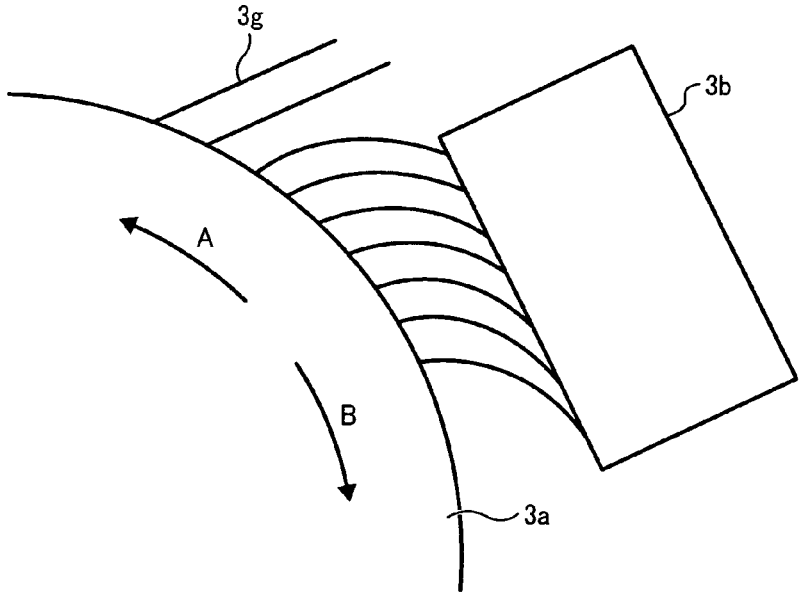

FIGS. 4A and 4B are magnified views of a brush roller to explain how the brush roller 3*a* works. FIG. 4A is a magnified cross-sectional views of a brush roller in an axial direction. One side with respect to the axis is omitted. FIG. 4B is a magnified views of a brush roller to show how the brush roller touches a top portion of the lubricant. The brush roller 3*a* includes a cylindrical member 3*f* and a coating brush 3*h* that is an aggregate of brush fibers 3*g*. The cylindrical member 3*f* is formed of metal or paper. At the one end of the cylindrical member 3*f*, plate springs 3*j* and a pair of notches 3*k* to engage the plate springs 3*j* are formed.

A rotary shaft 3*m* is provided by being introduced through one side portion 1*a* of the lubricant storage case 3*e* that holds the photoconductor 1. A cylinder fixer 3*n* is provided at one end of the rotary shaft 3*m*, and a driving gear 3*p* connected to a drive motor, not shown, through a gear provided at another end of the rotary shaft 3*m*. The pair of plate springs 3*j* are fixed to the cylinder fixer 3*n*. The plate springs 3*j* are engaged by notches 3*k* formed on an envelope surface of the cylindrical member 3*f*. The cylindrical member 3*f* is supported by a similar structure such as a cylinder fixer 3*n* (which does not include a driving gear) at another side portion of the lubricant storage case 3*e*. With this configuration, the rotary shaft 3*m* is rotated by the drive motor, not shown, through the drive gear 3*p*. As a result, the cylindrical member 3*f* is rotated with a predetermined constant speed in a normal direction or in a reverse direction.

The brush fibers 3*g* of the coating brush 3*h* are formed of a large numbers of leiotrichous fibers. The fibers are implanted at appropriate points on the circumferential surface of the cylindrical member 3*f*. The fibers are bent in the circumferential direction so as to keep tops of the fibers in contact with the photoconductor 1.

More specifically, the brush fibers 3*g* are implanted in the whole area in a width direction by leaning intentionally in the same direction (toward rear direction at the normal rotation) with respect to the direction of the normal to the curve of the brush roller 3*a*.

The brush fibers 3*g* may be loop fibers. Each loop fiber is implanted to lean by keeping looping direction aligned in the axial direction and to lean in the forward rotational direction.

By controlling the drive motor, not shown, the cylindrical member 3*f* can be rotated in a normal rotation direction B (the same direction as the rotation direction of the surface of the photoconductor 1) or in a reverse rotation direction A. According to the rotation, the brush fibers 3*g* are also rotated in a normal rotation direction or in a reverse rotation direction by touching the solid lubricant 3*b*. A device controller, not shown, changes the rotational direction as needed, and controls each unit of the apparatus.

In FIG. 4B, the brush roller 3*a* is rotated in a direction shown by arrow B during normal rotation under normal printing conditions. Since the brush fibers 3*g* touch the solid lubricant 3*b* at a shallow angle, the ability of the fibers 3*g* to shave the solid lubricant 3*b* is reduced. At the design stage, the pressure member 3*d* is selected as appropriate manner and a bias force is adjusted. After the adjustment, the bias force is fixed. Thus, the necessary bias force is obtained.

By contrast, in a temporary coating mode that is a so-called lubricant coating mode, described later, the brush roller 3*a* is rotated in a reverse direction (shown by arrow A (with the same rotation speed but in a reverse direction, that is, in the opposite direction shown by the arrow B in FIG. 4B), the brush fibers 3*g* touch the solid lubricant 3*b* at a deep angle. Accordingly, the ability to shave the solid lubricant 3*b* is relatively high compared to the shaving ability under normal rotation conditions. As a result, it is possible to increase a coating amount of the solid lubricant at the reverse rotation condition compared to the coating amount under normal rotation conditions without any change in force.

Further, the coating brush 3*h* can perform cleaning function. When the brush fibers 3*g* are rotated, residual toner peeled off from the surface of the photoconductor is moved to a waste toner screw. When the waste toner screw is driven to rotate, waste toner is moved and is collected in a recycling unit, not shown.

For the solid lubricant 3*b* used in the lubricant coating device 3, fatty acids metal salts and fluorochemical fiber can be used. It is especially preferable to use fatty acids metal salts, which are straight-chain hydrocarbon fatty acids metal salts that include, for example, myristic acid, palmitic acid, stearic acid, allean acid. As a metal, lithium, magnesium, calcium, strontium, zinc, cadmium, aluminum, cesium, titanium and iron may be used. It is especially preferable to use stearic acid zinc that is a combination of stearic acid of fatty acids and zinc of metal salts.

The solid lubricant 3*b* formed of fatty acids metal salts to have a rectangular shape is fixed on the lubricant holder 3*c* by double-faced tape or an adhesive bond. The solid lubricant 3*b* may be pressed against the brush roller 3*a* either under its own weight or by a weight attached to the lubricant holder 3*c*. A plurality of the pressure members 3*d* is generally provided in a longitudinal direction of the lubricant holder 3*c* to positively bias the solid lubricant 3*b* against the lubricant holder 3*c*. Preferably, a pressure spring is employed as the pressure member 3*d* as shown in FIGS. 3A and 3B. As for the lubricant holder 3*c*, a steel sheet, such as SECC, may be used.

Since the solid lubricant 3*b* is consumed and the pressure exerted is decreased over time, a small spring constant for the pressure spring small is preferable so as not to change the pressure over time. Accordingly, it is possible to avoid fluctuation in the amount of lubricant consumed (the amount of lubricant coated onto the photoconductor 1 by the brush roller 3*a*). An easy way to lower the spring constant is to increase the diameter of the pressure spring. However, since it is not possible to install a pressure spring having a large diameter in a compact process cartridge, a spring having an oval shape may be employed instead for a compact process cartridge.

The image forming apparatus 100 according to the first embodiment employs a temporary lubricant coating mode in addition to the normal print mode as one of basic image forming operation modes under a known general apparatus control. The lubricant coating mode is performed whenever a new photoconductor or a new cleaning blade is installed or when a wide image is printed at high resolution. This is because new photoconductors and cleaning blades tend not to be sufficiently coated with lubricant and are thus in a condition in which filming and cleaning failure occur easily, and the blade is easily rolled. When a wide image is printed at high resolution, cleaning failure may occur more frequently because more residual toner strikes the blade compared to a case in which an image of regular size is printed at normal resolution.

To avoid such cleaning failure, the lubricant coating mode is performed provisionally, that is, when it is needed. More specifically, the lubricant coating mode is carried out without performing image formation under a condition in which toner does not strike the blade.

Referring to a magnified view of a relevant contact part between the brush roller and the top portion of the lubricant according to the present invention shown in FIG. 4B, a coating operation to coat the lubricant will be now described.

In a normal print operation, the brush roller 3*a* is rotated with a constant speed in the normal rotation direction (counterclockwise direction) as shown by the arrow in FIG. 4B, the solid lubricant 3*b* is touched to the brush fibers 3*g* along a forward leaning direction of the fibers so that a proper amount of the lubricant is shaved off to coat the photoconductor 1. By contrast, in the lubricant coating mode, the brush roller 3*a* is rotated in the reverse direction, the brush fibers 3*g* are touched to the solid lubricant 3*b* against the slant of the fibers so that substantially more of the lubricant is shaved off and coated onto the photoconductor 1. Accordingly, the lubricant coating mode will be completed in much shorter time. Therefore, operation time is shortened, contributing to a longer service life for the related members.

It is to be noted that the above-described construction is different from the prior art. In prior-art image forming apparatuses, since the brush fibers 3*g* are implanted perpendicular to the surface of the brush, a coating amount shaved off the lubricant during normal rotation is equal to the coating amount shaved off the lubricant during reverse rotation if the rotation speeds between forward and reverse are equal. Accordingly, it is necessary to rotate the coating roller for a substantial period of time without performing an actual printing operation to obtain the necessary amount of lubricant. As a result, a waiting time is necessary for the user to wait without copying and printing. Further, rotating the coating roller without performing an actual printing operation puts wear on the bearings over which the photoconductor slides and on the coating roller, thus adversely affecting the service life of the relevant members. This service life factor is not considered in the prior-art image forming apparatuses.

By contrast, by using the brush roller according to the above-described embodiment, the coating amount is increased when the brush roller is rotated in the reverse direction in the corresponding lubricant coating mode. Accordingly, the rotating operation time without performing any actual print operation is reduced, so that the user does not have to wait excessively to begin printing. Further, the service life of the cleaning device is extended.

[Second Embodiment]

An image forming apparatus 100A according to a second embodiment of the present disclosure will now be described.

In this second embodiment, besides a brush roller a rubber roller or a sponge roller may be used as the coating roller.

More specifically, the present inventor has found that the amount of lubricant involved differs depending on polishing marks formed on the surface of the rubber roller and the sponge roller in a circumference direction. These polishing marks are projections extending in the axial direction of the roller and are described later. When the polishing marks touch the lubricant at a shallow angle, the lubricant is shaved by a small amount. When the polishing marks touch the lubricant at a deep angle, the lubricant is shaved by a large amount.

Based on this fact, in the cleaning device according to the second embodiment, the rubber roller or the sponge roller having projections, described later, is employed as the coating roller. In the lubricant coating mode, the coating roller is rotated in reverse. Accordingly, the amount of lubricant shaved off is increased. As a result, the lubricant coating mode will be completed in a much shorter time without making the user wait excessively to begin printing, and the service life of sliding members such as bearings is extended.

The image forming apparatus 100A according to the second embodiment has the same configuration as that of the image forming apparatus 100 according to the first embodiment shown in FIGS. 1 and 3, except for a configuration of the coating roller. Accordingly, a description of the configuration of the image forming apparatus 100A besides the coating roller is omitted, and a description relating solely to the coating roller is described referring to FIG. 5.

Figure 5:
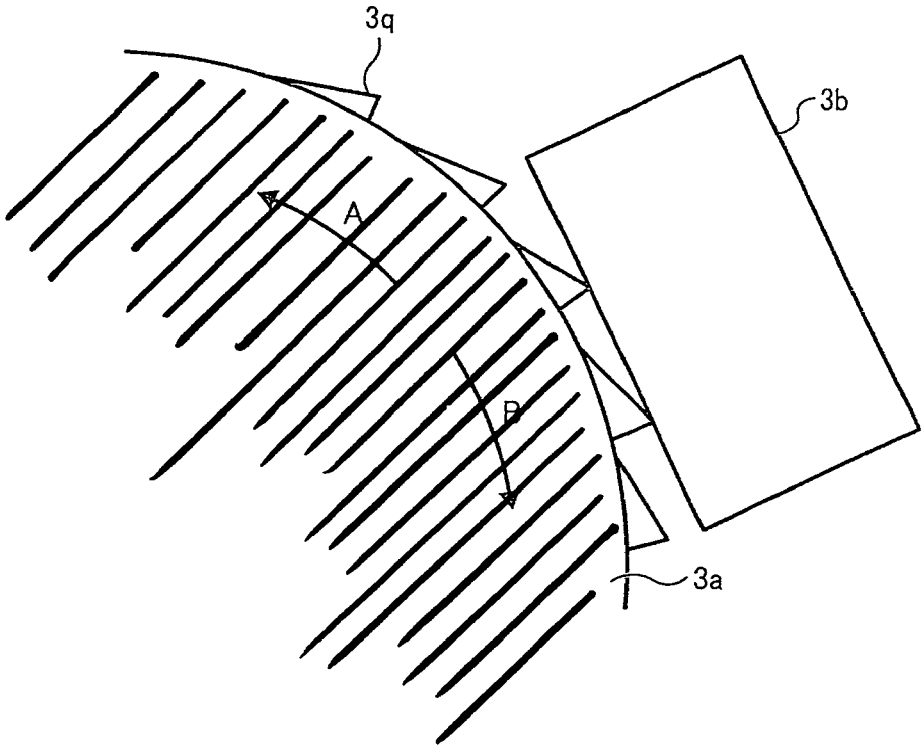
FIG. 5 is a magnified view of a contact portion between a coating roller and a top portion of the lubricant according to a second embodiment.

FIG. 5 is a magnified cross-section view of a contact portion between the brush roller 3*a* and a top portion of the lubricant. The brush roller 3*a* according to the second embodiment is a rubber roller or a sponge roller. A plurality of the projections 3*q* is formed along the entire circumferential surface of the roller. Each projection extends in the axial direction of the roller and outward radially from the surface of a body of the roller, and as can be seen in FIG. 5 has an asymmetrical shape with respect to a normal line to the curve of the roller on the cross section of the projection. The projections 3*q* may be formed at a downstream step of manufacturing process, or they may be formed by molding in a single piece to integrate the projections with the body of the roller.

As shown in FIG. 5, the projections 3*q* are formed on the surface of the roller (hereinafter described as polishing marks 3*q*) and are arranged at regular intervals. Each projection 3*q* is formed so that an angle of a sloping surface of the projection at a leading side in a traveling direction is small compared to an angle of a sloping surface at a trailing opposite side when the roller is rotated in a normal rotation direction (in a counterclockwise rotation as shown by the arrow in FIG. 5). It is acceptable that the projections 3*q* are not arranged on successive streams in the axial direction, and the projections 3*q* may be dispersed, that is, arranged at separated positions. However, the projections 3*q* are provided to be distributed as a whole together in the axial direction with the projections formed in other lines.

In the coating roller with the above-described arrangement, when the coating roller is rotated in a normal direction (shown by arrow B), the projection marks 3*q* touch the solid lubricant 3*b* with a forward direction of the projection where the solid lubricant 3*b* touches a sloping surface of the projection at the leading edge in a traveling direction having a small angle, so that the ability to shave the solid lubricant 3*b* is low similarly to the brush roller. By contrast, when the coating roller is rotated in a reverse direction (shown by arrow A), the projection marks 3*q* touch the solid lubricant 3*b* against the direction of the projection, where the solid lubricant 3*b* touches a sloping surface of the projection at the trailing edge having a large angle, so that the ability to shave the solid lubricant 3*b* is high compared to the shaving ability under the normal rotation condition. As a result, it is possible to increase the coating amount of the solid lubricant during reverse rotation compared to during normal rotation even with an equal pressure exerted.

It is possible to obtain different coating amounts suitable for a normal mode and for a lubricant coating mode by adjusting the bias force of the pressure member 3*d* at the design stage. Thus, according to the second embodiment, the coating amount of the solid lubricant can be increased under the reverse rotation condition. The rotating operation time without performing any actual printing operation can shortened so that the user does not have to wait excessively for printing to begin. Further, the service life of the cleaning device is extended.

Further, as for coating roller (brush roller) according to the first embodiment, a loop brush may be employed instead of the brush formed of leiotrichous fibers. Using a loop brush makes it possible to improve removing performance to remove unnecessary products, for example, Nox and silica, attached to the photoconductor 1.

Further, according to the second embodiment, each projection extends in the axial direction to have an asymmetrical shape with respect to a normal line to the curve of the roller on the cross section of the projection. Alternatively, each projection may have a planar shape tilted at a predetermined angle to the surface of the body of the roller.

Further, as for a subject to be cleaned, it may be an endless belt.

The above-described embodiments are illustrative, and numerous additional modifications and variations are possible in light of the above teachings. For example, elements and/or features of different illustrative and embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present patent application are possible in light of the above teachings. It is therefore to be understood that, the present patent application may be practiced otherwise than as specifically described herein.

What is claimed is:

1. A cleaning device, comprising:

a cleaning blade configured to clean a surface of a rotating subject to be cleaned;

a solid lubricant configured to reduce a friction coefficient of the surface of the subject; and a lubricant coating device including a coating roller to shave the solid lubricant by rotating in a normal rotation direction and a reverse rotation direction to coat the surface of the subject with the lubricant, wherein different amounts of the lubricant are supplied to the subject during normal rotation of the coating roller and during reverse rotation of the coating roller, wherein the cleaning device is operable in multiple operating modes including a normal operation mode and a lubricant coating mode, wherein, in the lubricant coating mode, an amount of the lubricant supplied to the subject is increased by rotating the coating roller in reverse compared to an amount of the lubricant supplied to the subject in a normal operation mode, wherein the coating roller rotates at a same rotating speed in both the normal rotation during the normal operating mode and the reverse rotation during the lubricant coating mode, wherein the coating roller is any one of a brush roller, a rubber roller or a sponge roller, and includes projections extending in an axial direction of the coating roller, wherein the projections are provided on a surface of the coating roller to extend at an angle, such that, the projections touching the solid lubricant is at a shallow angle under a normal rotation condition, and the projections touching the solid lubricant is at a deep angle under a reverse rotation condition.

2. The cleaning device of claim 1, wherein the brush roller includes a body and brush fibers attached to the body, the brush fibers corresponding to the projections, wherein the brush fibers are implanted in the body of the coating roller to lean with a angle in a circumferential direction of the roller, such that the brush fibers of the brush roller touching the solid lubricant is at the shallow angle with respect to the fibers under the normal rotation condition, and the brush fibers of the brush roller touching the solid lubricant is at the deep angle against the fibers under the reverse rotation condition.

3. The cleaning device of claim 1, wherein the rubber roller includes polishing marks arranged at regular intervals on a surface of the coating roller in a circumferential direction, the polishing marks corresponding to the projections, each polishing mark having an asymmetrical shape with respect to a normal line to a curve of the roller on a cross section of the projection, such that, the polishing marks touching the solid lubricant during normal rotation of the roller is at the shallow angle, and the polishing marks touching the solid lubricant during reverse rotation of the roller is at the deep angle.

4. A process cartridge comprising:

a photoconductor that is a subject to be cleaned; and the cleaning device of claim 1, wherein the photoconductor and the cleaning device are integrated in the process cartridge.

5. An image forming apparatus comprising:

an image carrier configured to form an electrostatic latent image;

a charging device configured to charge a surface of the image carrier uniformly by a charging member applied with a potential externally;

an exposure unit configured to write the electrostatic latent image on the charged surface of the image carrier based on image data;

a developing device configured to visualize the electrostatic latent image formed on the surface of the image carrier;

a transfer unit configured to transfer the visualized image on the surface of the image carrier onto a medium; and the cleaning device of claim 1.

6. The cleaning device of claim 1, wherein the sponge roller includes polishing marks arranged at regular intervals on a surface of the coating roller in a circumferential direction, the polishing marks corresponding to the projections, each polishing mark having an asymmetrical shape with respect to a normal line to a curve of the roller on a cross section of the projection, such that, the polishing marks touching the solid lubricant during normal rotation of the roller is at the shallow angle, and the polishing marks touching the solid lubricant during reverse rotation of the roller is at the deep angle.

7. A cleaning device, comprising:

a cleaning blade configured to clean a surface of a rotating subject to be cleaned;

a solid lubricant configured to reduce a friction coefficient of the surface of the subject; and a lubricant coating device including a coating roller to shave the solid lubricant by rotating in a normal rotation direction and a reverse rotation direction to coat the surface of the subject with the lubricant, wherein different amounts of the lubricant are supplied to the subject during normal rotation of the coating roller and during reverse rotation of the coating roller, wherein the cleaning device is operable in multiple operating modes including a normal operation mode and a lubricant coating mode, wherein, in the lubricant coating mode, an amount of the lubricant supplied to the subject is increased by rotating the coating roller in reverse compared to an amount of the lubricant supplied to the subject in a normal operation mode, wherein the coating roller rotates at the same rotating speed in both the normal rotation during the normal operating mode and the reverse rotation during the lubricant coating mode, wherein the coating roller is a brush roller including a body and brush fibers attached to the body, wherein the brush fibers are implanted in the body of the coating roller to lean with an angle in a circumferential direction of the roller, such that, the brush fibers of the brush roller touching the solid lubricant is at a shallow angle with respect to the fibers under a normal rotation condition, and the brush fibers of the brush roller touching the solid lubricant is at a deep angle against the fibers under a reverse rotation condition.

8. A process cartridge comprising:

a photoconductor that is a subject to be cleaned; and the cleaning device of claim 7, wherein the photoconductor and the cleaning device are integrated in the process cartridge.

9. An image forming apparatus comprising:

an image carrier configured to form an electrostatic latent image;

a charging device configured to charge a surface of the image carrier uniformly by a charging member applied with a potential externally;

an exposure unit configured to write the electrostatic latent image on the charged surface of the image carrier based on image data;

a developing device configured to visualize the electrostatic latent image formed on the surface of the image carrier;

a transfer unit configured to transfer the visualized image on the surface of the image carrier onto a medium; and the cleaning device of claim 7.

10. A cleaning device, comprising:

a cleaning blade configured to clean a surface of a rotating subject to be cleaned;

a solid lubricant configured to reduce a friction coefficient of the surface of the subject; and a lubricant coating device including a coating roller to shave the solid lubricant by rotating in a normal rotation direction and a reverse rotation direction to coat the surface of the subject with the lubricant, wherein different amounts of the lubricant are supplied to the subject during normal rotation of the coating roller and during reverse rotation of the coating roller, wherein the cleaning device is operable in multiple operating modes including a normal operation mode and a lubricant coating mode, wherein, in the lubricant coating mode, an amount of the lubricant supplied to the subject is increased by rotating the coating roller in reverse compared to an amount of the lubricant supplied to the subject in a normal operation mode, wherein the coating roller rotates at the same rotating speed in both the normal rotation during the normal operating mode and the reverse rotation during the lubricant coating mode, wherein the coating roller is a rubber roller or a sponge roller, and includes polishing marks arranged at regular intervals on a surface of the coating roller in a circumferential direction, each polishing mark having an asymmetrical shape with respect to a normal line to a curve of the roller on a cross section of the projection, such that, the polishing marks touching the solid lubricant during normal rotation of the roller is at a shallow angle, and the polishing marks touching the solid lubricant during reverse rotation of the roller is at a deep angle.

11. A process cartridge comprising:

a photoconductor that is a subject to be cleaned; and the cleaning device of claim 10, wherein the photoconductor and the cleaning device are integrated in the process cartridge.

12. An image forming apparatus comprising:

an image carrier configured to form an electrostatic latent image;

a charging device configured to charge a surface of the image carrier uniformly by a charging member applied with a potential externally;

an exposure unit configured to write the electrostatic latent image on the charged surface of the image carrier based on image data;

a developing device configured to visualize the electrostatic latent image formed on the surface of the image carrier;

a transfer unit configured to transfer the visualized image on the surface of the image carrier onto a medium; and the cleaning device of claim 10.

* * * * *